US005265454A

United States Patent [19]

Crocco et al.

[11] Patent Number: 5,265,454

[45] Date of Patent: Nov. 30, 1993

[54] COMBINED LOCK AND LATCH

[75] Inventors: John Crocco, Buffalo Grove; Herbert Kincaid, Libertyville, both of Ill.

[73] Assignee: Eastern Company, Naugatuck, Conn.

[21] Appl. No.: 794,475

[22] Filed: Nov. 19, 1991

[51] Int. Cl.[5] ..... E05B 9/10

[52] U.S. Cl. ..... 70/380; 70/101; 70/492

[58] Field of Search ..... 70/207, 209, 215, 216, 70/224, 372, 373, 376, 377, 379-380, 491, 492

[56] References Cited

U.S. PATENT DOCUMENTS

| | | | |
|---|---|---|---|
| 841,493 | 1/1907 | Fairbank | 70/101 |
| 1,621,549 | 3/1927 | Lanphere | 70/380 X |
| 2,115,680 | 4/1938 | Dyson | 70/380 X |
| 2,182,307 | 12/1939 | Behnke | 70/492 X |
| 2,255,402 | 9/1941 | Vile | 70/380 X |
| 2,580,882 | 1/1952 | Blohm | 70/492 X |
| 2,585,643 | 2/1952 | Feldmann | 70/492 X |
| 3,973,421 | 8/1976 | Patriquin | 70/492 |
| 4,903,512 | 2/1990 | Leroy et al. | 70/380 X |
| 4,936,895 | 6/1990 | Leclerc et al. | 70/380 |
| 5,044,183 | 9/1991 | Neyret | 70/380 X |
| 5,070,716 | 12/1991 | Whorlow | 70/380 X |

*Primary Examiner*—Peter M. Cuomo
*Assistant Examiner*—Suzanne L. Dino
*Attorney, Agent, or Firm*—Wood, Phillips, VanSanten, Hoffman & Ertel

[57] ABSTRACT

A combined lock and latch for use with an exterior compartment door on a recreational vehicle has a cylindrical barrel and a rotatable plug mounted within an axial opening formed in the barrel. A number of spring-biased, key retractable tumblers extend through the plug and are received in a narrow slot formed in the barrel to prevent the plug from rotating relative to the barrel when the plug is in a locked position. A metal cam having mutually perpendicular legs is mounted at one end of the key plug, with one of the cam legs engaging a fixed keeper when the plug is in the locked position. An arcuate groove is formed on the barrel and receives the tumblers when the key plug is in latched and unlatched positions. The groove sweeps through approximately 90 degrees and allows the plug to be freely rotated without the use of a key. A second leg on the metal cam engages the keeper when the key plug is the latched position.

8 Claims, 2 Drawing Sheets

COMBINED LOCK AND LATCH

BACKGROUND OF THE INVENTION

1. Technical Field

The present invention is a multi-function mechanism which provides a key locking and a manual latching and unlatching mode of operation in a closure.

2. Background Art

Accessibility requirements of some compartments, such as compartments to which a group of individuals require independent access, have key operated locks for securing cargo in the compartment. Exterior cargo compartments in recreational vehicles represent exemplary closures having such accessibility requirements Although present key locks effectively secure compartments from undesired access, it often is problematic to require each of the individuals who are authorized to access the compartment to have their own key. For instance, keys may become lost or unauthorized individuals might acquire a key. Also, each authorized individual must be provided with a key.

U.S. Pat. No. 2,585,643 to Feldman shows a compartment door lock which can be alternatively used in a key operable mode and a keyless, manually operable mode. In the key operable mode, key retractable tumblers are received in a narrow slot in a lock barrel to prevent rotation of a cylindrical key plug. The key plug has an integrally formed retracting lug which engages a cam lug formed on radially movable latch bolt. Rotation of the key plug and interaction of the retracting lug and cam lug cause the latch bolt to retract and release a keeper. In the manually operable mode, the tumblers are received in a wider slot which allows rotation of the key plug with the key withdrawn and the tumblers extended.

SUMMARY OF THE INVENTION

A combined lock and latch according to the present invention is mounted to the door of an exterior compartment in a recreational vehicle. The combined lock and latch operates in a locking mode in which the door is prevented from being opened without the use of an appropriate key. The combined lock and latch alternatively operates in a latching mode of operation and can be freely moved between a latched position and an unlatched position without the use of the key.

In the exemplary embodiment of the invention, a combined lock and latch for a compartment closure has a cylindrical barrel and a rotatable key plug mounted within an opening in the barrel. Spring-biased retractable tumblers extend through the plug and engage a first slot formed in the barrel to prevent the plug from rotating relative to the barrel in a locking mode of operation. A laterally extending cam leg projects from the plug and engages a fixed keeper on the compartment to prevent the door from being opened.

A second slot in the form of an arcuate groove is formed on the barrel and sweeps through approximately 90 degrees Insertion of a key into the locked key plug retracts the tumblers and allows the plug to be freely rotated within the barrel. When the tumblers register with the second slot, removal of the key causes the tumblers to extend into the second slot. The key plug then can be freely rotated without the key and the combined lock and latch operates as a latch, with a second laterally extending cam leg engaging the keeper.

Manually engageable ears are provided on the plug to assist rotation of the plug when the key is removed.

Each of the first and the second laterally extending cam legs are formed integrally as a flat metal plate to define a cam which is rotatably mounted on one end of the key plug. The legs are mutually perpendicular such that when the key plug is rotated 90 degrees from the locked position, wherein the first leg engages the fixed keeper, the first leg is pivoted out of engagement with the keeper and the second leg in turn engages the keeper.

A stop is provided for limiting rotation of the plug when the tumblers are retracted. An axial tooth projects from one end of the barrel and defines a pair of circumferentially spaced walls. A stop washer having a pair of spaced apart abutments is rotatable with the key plug with the abutments contacting the walls to limit rotation of the key plug and the cam. In the exemplary embodiment, the stops are spaced apart to limit rotation of the key plug to approximately 180 degrees.

BRIEF DESCRIPTION OF THE DRAWINGS

Other features and advantages of the invention will be apparent from the following detailed description taken in connection accompanying drawings wherein.

DETAILED DESCRIPTION OF THE INVENTION

Figure 1:
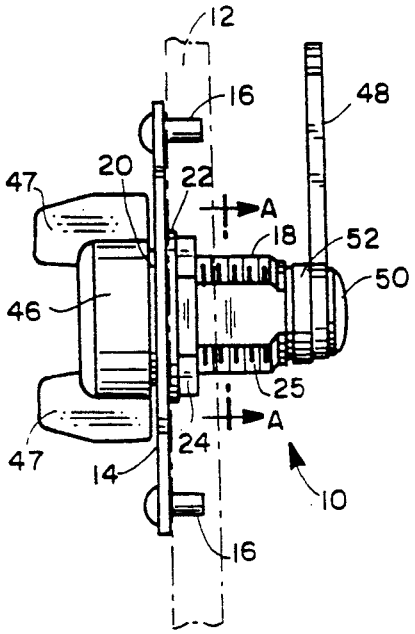
FIG. 1 is a diagrammatic side view of a combined lock and latch according to the present invention, and illustrating a right side view of FIG. 6 with the keeper not shown to facilitate an understanding of the invention.

A combined lock and latch mechanism 10 according to the present invention is shown in FIG. 1 and is mounted to a compartment door 12 of a recreational vehicle (not shown). In a locking mode of operation, the mechanism 10 prevents the compartment door 12 from being opened without the use of an appropriate key. As will be described hereafter, when the mechanism 10 is placed in a latching mode of operation, the mechanism 10 can be freely moved between a latched position and unlatched position and the compartment door 12 can be opened without the use of the key.

While the exemplary embodiment illustrates the use of the combined lock and latch mechanism 10 with a compartment door on a recreational vehicle, it should be understood that the mechanism 10 can also be used with other types of closures in which it is desirable to achieve an alternate locking and latching mode of operation.

The combined lock and latch mechanism 10 is fixed to the compartment door 12 by a flat mounting plate 14 which is attached to the door with a pair of fasteners 16. The mechanism 10 has an elongated lock barrel 18 which projects axially through the door 12 and the mounting plate 14, with the mounting plate 14 clamped between an annular shoulder 20 formed on the lock barrel 18 and a lock washer 22 and adjustable nut 24. Nut 24 is adjustable along threads 25 formed on the outer surface of the lock barrel 18.

Referring also to FIGS. 2 through 5, lock barrel 18 has a tubular opening 26 which receives a generally cylindrical key plug 28. A first end 30 of the lock barrel is enlarged to define an annular rearward facing shoulder 32. An opposite end 34 of the barrel has a pair of diametrically spaced symmetric flats 36 and 38 and an arcuate tooth 40 projecting axially from end 34 and defining a pair of oppositely directed stops 42 and 44 for purposes to be described hereafter.

The key plug 28 is rotatable within the lock barrel 18 with annular shoulder 32 seated in the center of a wing knob 46. The key plug 28 projects through the lock barrel and extends beyond the lock barrel end 34. A cam 48 is fixed to the end of key plug 28 by a fastener 50. A stop washer 52 is keyed to the end of the key plug 28 and is clamped between the end of the lock barrel 18 and the cam 48.

Figure 4:
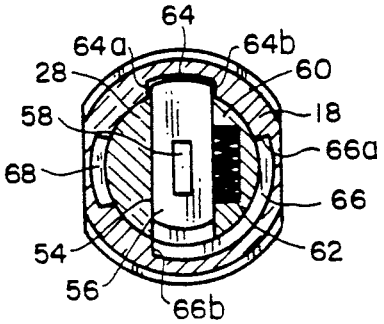
FIG. 4 is a vertical section taken along line A—A of FIG. 1.
Figure 2:
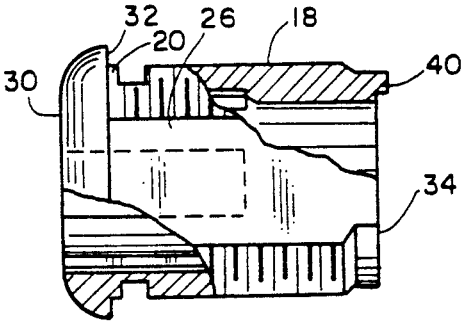
FIG. 2 is a cut away side view of the lock barrel shown in FIG. 1.
Figure 3:
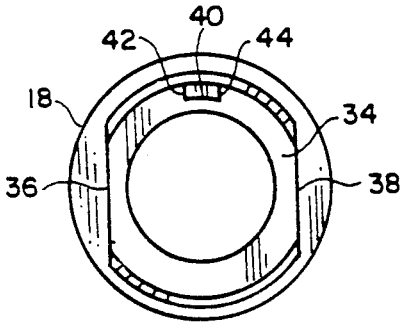
FIG. 3 is a rear end view of the lock barrel shown in FIG. 2.

A number of tumbler ways 54 extend radially in the key plug 28 and each receive a flat tumbler 56 (one shown in FIG. 4). Each tumbler 56 includes a key slot 58 and an arm 60 which abuts a compression spring 62 within the key plug 28, so that the tumbler 56 is radially biased out of the tumbler way 54 and extended into one of three axial slots 64, 66 or 68 formed in the lock barrel 18.

Slot 64 extends arcuately between a pair of stops **64*a* and 64*b* formed on the lock barrel 18, with the distance between stops 64*a* and 64*b* being slightly greater than the width of the tumblers 56. When a tumbler 56 is radially displaced by a compression spring 62 and received in slot 64, as shown in FIG. 4, the tumbler 56 abuts stops 64*a* and 64*b* and the key plug 28 cannot be rotated relative to the lock barrel 18**.

Slot 66 extends longitudinally within the lock barrel 18 and is circumferentially spaced approximately 90° from slot 64. Slot 66 arcuately spans approximately 90° between a pair of spaced stops **66*a* and 66*b* formed in the lock barrel 18, so that when the radially displaced tumblers 56 are received within slot 66, the key plug 28 is rotatable relative to the lock barrel 18 over a range of approximately 90° with the tumblers 56 captured between stops 66*a* and 66*b***.

Slot 68 is formed in the lock barrel 18 approximately midway between stop **64*a* on axial slot 64 and stop 66*b* on slot 66 and has a width substantially equal to the width of axial slot 64**.

The tumbler key slots 58 are arranged so that when a serrated key (not shown) is inserted through the key slots, the tumblers 56 are retracted out of engagement with the axial slots 64, 66 or 68 and contained completely within the tumbler ways 54 so that the key plug 28 may be rotated relative to the lock barrel 18. A rotary force is applied to manually engageable ears 47 formed on the wing knob 46 and the key plug 28 is rotated within the lock barrel 18 until the tumbler ways 54 register with one of the axial slots 64 or 66, at which point the key is withdrawn from the lock.

Figure 7:
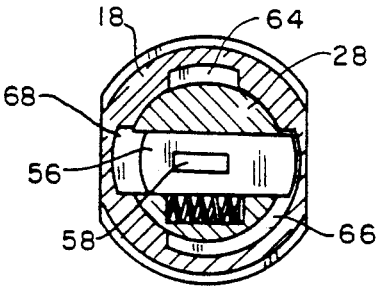
FIG. 7 is a vertical section similar to FIG. 4 with the key plug in a latched position.

As the serrated key passes through the key slots 58 when the key is withdrawn, the tumblers 54 are radially displaced in a direction opposite the biasing force of compression spring 62. When the key is withdrawn from the key plug 28 with the key plug positioned as shown in FIG. 4, the tumblers are initially forced into slot 66. When the key is withdrawn from the key plug 28 with the key plug positioned as shown in FIG. 7, the tumblers are initially forced into slot 68. Once the key is separated from the key slots 58, the compression springs 62 force the tumblers into slot 64 (FIG. 4) or slot 66 (FIG. 7).

Figure 5:
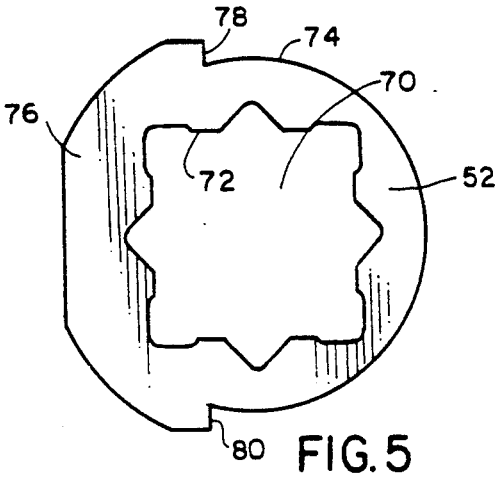
FIG. 5 is an end view of the stop washer.

Stop washer 52 is shown in FIG. 5 and has a central keyway 70 defined by an irregular cut out 72 for rotatable engagement with the end of key plug 28 The stop washer has a substantially circular edge 74 extending around a first portion of the washer and an enlarged edge portion 76 extending around the remainder of the periphery of the washer. Edge portions 74 and 76 meet to define a pair of abutments 78 and 80 on the stop washer 52. When the tumblers 56 are fully retracted within the tumbler ways 54 in the key plug 28, the key plug is freely rotatable within the opening 26 in the lock barrel 18 until one of the abutments 78 or 80 on the stop washer 52 engages one of the stops 42 or 44 on axial tooth 40. The key plug 28 is then rotatable in an opposite direction until the other of the abutments 78 or 80 engages the other of the stops 42 or 44. The abutments 78 and 80 are circumferentially spaced on stop washer 52 to limit rotation of the key plug 28 relative to the lock barrel 18 to 180°.

Figure 6:
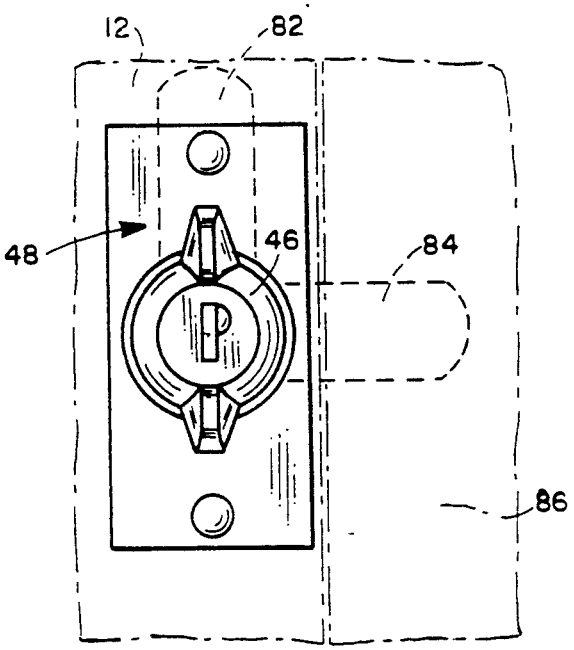
FIG. 6 is a front end view of the lock shown in FIG. 1 and illustrating the lock in a locked position.

The cam 48 is formed from a metal plate and has a pair of mutually perpendicular legs 82 and 84 formed integrally therewith. Fastener 50 extends through the cam 48 and into key plug 28 to clamp the cam and stop washer 52 against the end 34 of the lock barrel 18. Rotation of the key plug 28 thereby results in rotation of the legs 82 and 84 on the cam 48, with the rotation limited by the engagement of abutments 78 and 80 with stops 42 and 44, respectively Operation of the key lock 10 may be summarized as follows. In a locked position (FIGS. 1, 4 and 6) the key plug 28 is positioned with the cam leg 82 extending vertically upward behind compartment door 12 and with the cam leg 84 projecting laterally beyond the edge 85 of the door 12 to engage an adjacent keeper 86. Keeper 86 can be a surrounding door frame supporting the door for pivotal movement or other fixed structure adjacent the compartment door 12 and suitable for fixedly engaging the leg 84. Tumblers 56 are radially biased into axial slot 64 and constrained between stops **64*a* and 64*b* to prevent rotation of the key plug 28. Because cam 48 is rotatably fixed to the key plug 28, the engagement of leg 84 with the keeper 86 prevents the compartment door 12** from being opened.

Figure 8:
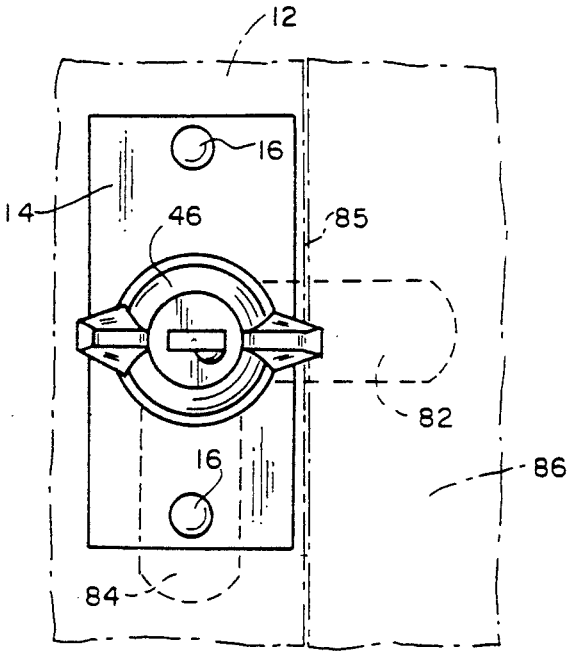
FIG. 8 is an end view of the lock shown in FIG. 1 and illustrating the lock in a latched position.

To unlock the door 12, a serrated key is inserted through the key slots 56 to retract tumblers 56 within the tumbler ways 54. The key plug 28 and the cam 48 then are rotated approximately 90° in a clockwise direction, as viewed in FIGS. 6 and 7, to a latched position (FIG. 8). The key is then removed from key slots 58 and tumblers 56 are radially biased into arcuate slot 66. As noted above, when the key is withdrawn from the key slots 58, the tumblers 56 are initially forced into slot 68. Slot 68 is therefore required to enable withdrawal of the key.

In the latched position, engagement of leg 82 with the keeper 86 prevents the compartment door 12 from being opened without further rotation of the key plug 28. The leg 84 extends perpendicularly from cam leg 82 inwardly of the door edge 85 when the key plug 28 is in the latched position. Because slot 66 in the lock barrel 18 is substantially wider than the tumblers 56, the key plug 28 can be rotated up to 90° without requiring retraction of the tumblers. The ears 47 on wing knob 46 are gripped and rotated 90° until the tumblers engage stop 66*b*, of slot 66, causing the cam 48 to rotate and release the deeper 86. The leg 84 continuously maintains a perpendicular relationship with the leg 82 during rotation of the cam 48. The compartment door 12 then can be opened. Counterclockwise rotation of the wing knob 46 engages the cam leg 82 with keeper 86 to return the lock to a latched, unlocked position in which the door can be opened without the use of the key.

We claim:

1. A combined lock and latch for a closure element movable with respect to a fixed keeper, comprising:

a lock barrel in said closure element, with an opening therein;

a plug within the barrel opening and rotatable between a locked position and latched / unlatched positions, said plug having a keyway;

a tumbler in said plug, said tumbler being retractable in response to insertion of a key into said keyway and biased into an extended position in response to withdrawal of the key from said keyway;

a first slot on the barrel for receiving the tumbler to prevent rotation of the plug relative to the barrel with the plug in the locked position;

a second slot on the barrel for receiving the tumbler with the plug in the latched / unlatched positions;

a first cam leg on the plug engaging the keeper in the locked position; and a second cam leg on the plug engaging the keeper in the latched position and spaced from the keeper in the unlatched position to release the closure element, the plug being rotatable between the latched position and the unlatched position with the tumbler in the extended position and the key withdrawn from said keyway to facilitate latching and unlatching of the closure element without the key.

2. The combined lock and latch of claim 1 including manually engageable ears on the plug for rotating the plug between the latched and unlatched position with the key removed from said keyway.

3. The combined lock and latch of claim 1 in which the first slot is angularly spaced approximately 90 degrees from the second slot.

4. The combined lock and latch of claim 1 in which the second slot is an arcuate opening sweeping at least 90 degrees, the second slot receiving the tumbler to allow the plug to rotate at least 90 degrees when the tumbler is in the extended position thereof.

5. The combined lock and latch of claim 1 in which the barrel has a stop for limiting rotation of the plug when the tumbler is retracted.

6. The combined lock and latch of claim 5 in which the stop is an axial tooth projecting from one end of the barrel, and including a washer mounted on the key plug and having circumferentially spaced shoulders engageable with opposite sides of the tooth in response to rotation of the plug.

7. The combined lock and latch of claim 6 in which the axial tooth and the spaced shoulders are arranged such that one shoulder abuts a first side of the tooth when the plug is in the locked position, and the other shoulder abuts a second side of the tooth when the plug is in the unlatched position.

8. A combined lock and latch for a closure element movable with respect to a fixed keeper and operable to (1) engage the keeper in a locked position wherein a key is required to release the keeper and open the closure element, and (2) engage the keeper in a latched position wherein a key is not required to release the keeper and open the closure element, the combined lock and latch comprising:

a lock barrel in said closure element, with an opening therein;

a plug within the barrel opening and rotatable between the locked position and the latched position, said plug having a keyway;

at least one tumbler in said plug, said tumbler being retractable in response to insertion of a key into said keyway and biased into an extended position in response to withdrawal of the key from said keyway;

a first cam leg rotatable with the plug and engaging the keeper in the locked position;

a second cam leg rotatable with the plug and engaging the keeper in the latched position;

a first slot on the barrel for receiving an extended tumbler to prevent rotation of the plug relative to the barrel in the locked position;

a second slot on the barrel for receiving an extended tumbler with the plug in the latched position, the second slot allowing movement of the extended tumbler when said tumbler is received therein and said key is withdrawn from the keyway to facilitate release of the keeper without the key.

* * * * *